United States Patent [19]

Demuth

[11] Patent Number: 4,483,372

[45] Date of Patent: Nov. 20, 1984

[54] TENSIONING APPARATUS FOR A WHIP ROLL OF A WEAVING MACHINE

[75] Inventor: Hans Demuth, Winterthur, Switzerland

[73] Assignee: Sulzer Brothers, Ltd., Winterthur

[21] Appl. No.: 489,390

[22] Filed: Apr. 28, 1983

[30] Foreign Application Priority Data

Apr. 29, 1982 [CH] Switzerland ..... 2605/82

[51] Int. Cl.[3] ..... D03D 49/22

[52] U.S. Cl. ..... 139/114

[58] Field of Search ..... 139/449, 114, 115

[56] References Cited

U.S. PATENT DOCUMENTS 2,966,930 1/1961 Pfarrwaller ..... 139/114

3,198,215 8/1965 Tinkham ..... 139/449

4,127,150 11/1978 Steverlynck ..... 139/449

FOREIGN PATENT DOCUMENTS 772796 8/1934 France ..... 139/114

*Primary Examiner*—Henry S. Jaudon

*Attorney, Agent, or Firm*—Kenyon & Kenyon

[57] ABSTRACT

The tensioning apparatus for adjusting the tension of a whip roll in a weaving machine employs an adjustable eccentric element which is connected to the tension spring. The eccentric element includes an eccentrically mounted pin which can be moved about an axis of the eccentric element in order to make an adjustment in the force supplied to the tensioning lever by the spring.

16 Claims, 4 Drawing Figures

TENSIONING APPARATUS FOR A WHIP ROLL OF A WEAVING MACHINE

As is known, weaving machines have been provided with whip rolls over which warp yarns are passed. In addition, it has been known to mount the whip rolls in a manner so that the warp yarns can be tensioned. For example, use has been made of pivotally mounted levers for mounting the whip rolls on a frame of a weaving machine and force storage means for tensioning the levers. In some cases, for example as described in Swiss Pat. No. 400,036, it has been known to connect a pull rod between a tension spring which acts as a force storage means and one arm of a double-armed lever on which a whip roll is mounted. In this case, the engaged arm of the lever is provided with teeth having a specific curvature while the pull rod is provided with two bolts at one end for engaging in the teeth of the arm. In order to adjust the tension or the torque exerted on the tensioning lever, such a system must first be brought into an untensioned position, for example by pivoting the double-armed tensioning lever. The bolts then have to be moved to a different tooth gap and the system then has to be returned to the tensioning position.

One disadvantge of the known tensioning system is that the adjustment of the tension of the whip roll or of the force of the tensioning lever is carried out abruptly. Thus, tension variations of 5–6 kiloponds (kp) are possible from one notch or tooth gap to the next. In particular, when the warp yarns are arranged asymmetrically, the tension springs are subjected to different loading on the catching and picking sides. Thus, an exact tension equilization become impossible. As a result, irregularities may occur in the woven fabric.

It has also been known from German Offenlegungsschrift No. 29 11 863.6 to utilize a tensioning system comprising a toothed element, such as a pinion, worm or the like which cooperates steplessly with the teeth of the tensioning lever in order to adjust the torque exerted on a whip roll by a force storage means. However, this system requires a relatively considerable outlay with respect to manufacture.

Accordingly, it is an object of the invention to provide a tensioning apparatus for a whip roll in which exact tensioning equalization is possible.

It is another object of the invention to be able to adjust the tension on a whip roll in a very short time.

It is another object of the invention to provide a tensioning apparatus of relatively simple construction for adjusting the tension in a whip roll of a weaving machine.

Briefly, the invention provides a tensioning apparatus for a whip roll of a weaving machine which is comprised of at least one pivotally mounted double-armed lever, a force storage means connected to one arm of the lever in order to bias the lever in one direction and an adjustable eccentric element which is connected to the force storage means for adjusting the force exerted on the lever by the force storage means.

Where the tensioning apparatus is duplicated on opposite sides of a whip roll of a weaving machine, tension equalization is possible simply by turning each eccentric element without any need to move the engaged parts into a different engagement position.

In one embodiment, the double-armed lever is mounted on a support plate of a weaving machine and the eccentric element includes a shaft which is rotatably mounted in the plate and a pin which extends from the shaft in an eccentric manner for engagement with the force storage means. This embodiment permits a very simple adjustment of the tension imparted to the lever.

In another embodiment, the eccentric element may have a shaft rotatably mounted in a link which is connected to one end of the force storage means at the double-armed lever. In this case, the eccentric element also has a pin which extends from the shaft in an eccentric manner to engage with an arm of the lever. This permits an adjustment of the point of engagement of the force storage means in a longitudinal direction of the tensioning lever arm for the purpose of adjusting the force exerted thereon.

In addition, the arm of the tensioning lever may be povided with a plurality of longitudinally spaced teeth within which the eccentric pin of the eccentric element may engage. This permits a very simple utilization of the adjustment action of the eccentric element without requiring any operations on the plate on which the lever is mounted.

These and other objects and advantages of the invention will become more apparent from the following detailed description taken in conjunction with the accompanying drawings wherein.

Figure 1:
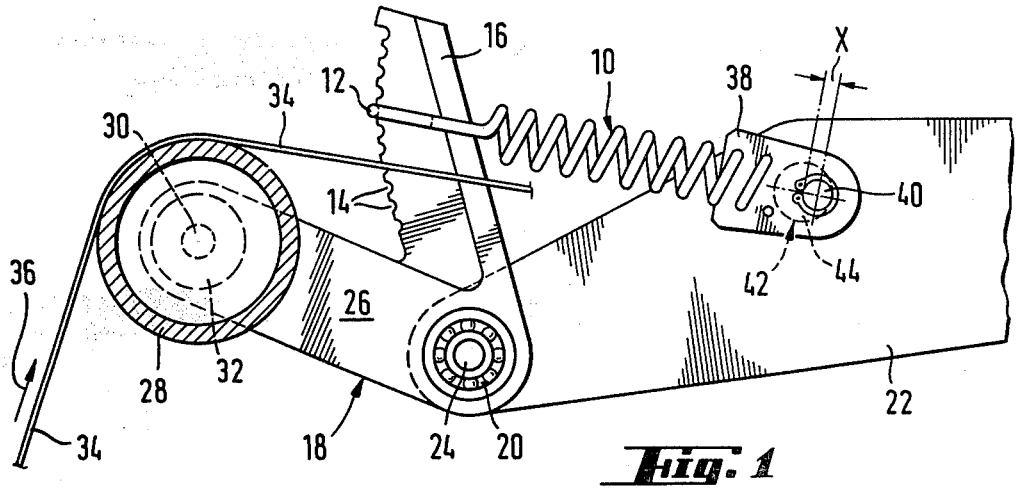
FIG. 1 illustrates a side view of a tensioning apparatus in accordance with the invention.
Figure 2:
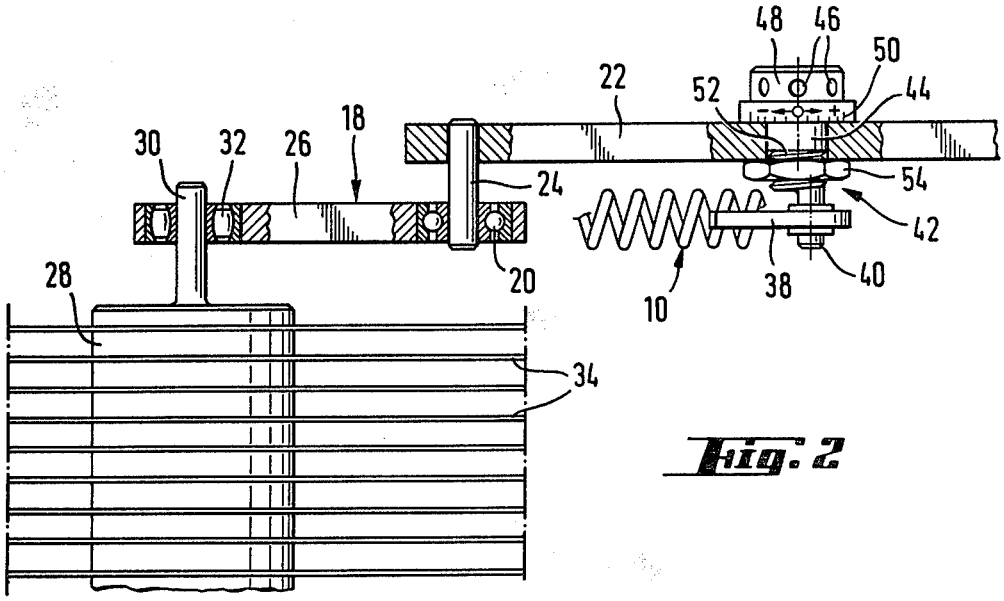
FIG. 2 illustrates a plan view of the tensioning apparatus of FIG. 1.

Referring to FIGS. 1 and 2, a weaving machine of known construction is provided with a stationary support plate 22 on which a double-armed lever 18 is pivotally mounted, for example via a bearing 20 which is supported by a spindle 24 secured in the support plate 22. As shown, the lever 18 has one arm 26 which carries one end of a whip roll 28 thereon. For example, the whip roll 28 has a spindle 30 which is mounted in a self-aligning roller bearing 32 in the arm 26. The whip roll 28 is disposed so that a plurality of warp yarns 34 can be moved over the roll 28 in the direction indicated by the arrow 36 (see FIG. 1) in known manner.

The second arm 16 of the lever 18 is provided with engagement means in the form of a plurality of longitudinally spaced teeth.

The tensioning apparatus also includes a force storage means in the form of a tension spring 10 which is connected to the arm 16 of the lever 18 via a hook-shaped end 12 in order to bias the lever 18 in a clockwise direction, as viewed. At the opposite end, the tension spring 10 is connected to a link 38 which, in turn, is fixed connected to an adjustable eccentric element 42. This eccentric element 42 serves to adjust the force exerted on the lever 18 by the spring 10.

As shown, the eccentric element 42 includes a shaft 44 which is rotatably mounted in the support plate 22 on a first axis as well as a pin 40 which extends from the shaft 44 in an eccentric manner on a second axis parallel to an spaced from the first axis. This pin 40 engages in the link 38 and is held therein, for example as shown in FIG. 1 by a circlip. The eccentric element also carries an adjusting head 48 which is formed with a plurality of circumferentially disposed recesses 46 and a scale 50. In addition, the shaft 44 is provided with a screw thread 52 on which a lock nut 54 is threaded. As indicated in FIG.

2, the adjusting head 48 and lock nut 54 serve to clamp the eccentric element 42 to the support plate 22.

During operation, the eccentric element 42 can be used to adjust the mounting of the spring 10 relative to the plate 22 and lever 18 and, thus, adjust the force exerted on the lever 18 by the spring 10. For example, in order to adjust the tension of the spring 10 during operation, the lock nut 54 is released and the adjusting head 48 turned into the required position of the scale 50 by means of a tool (not shown) engaged in one or more of the recesses 46. The lock nut 54 is then tightened. During this time, the link 38 is moved, for example by an amount X in the axial direction of the spring 10. This brings about a corresponding increase in the spring tension and, hence, of the force acting on the arm 16 of the lever 18.

Figure 3:
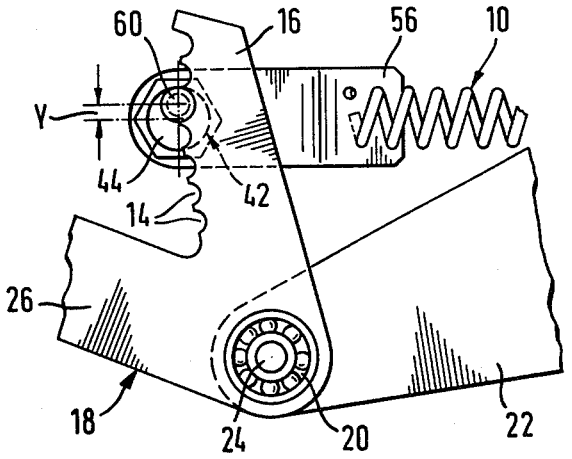
FIG. 3 illustrates a modified tensioning apparatus in accordance with the invention.
Figure 4:
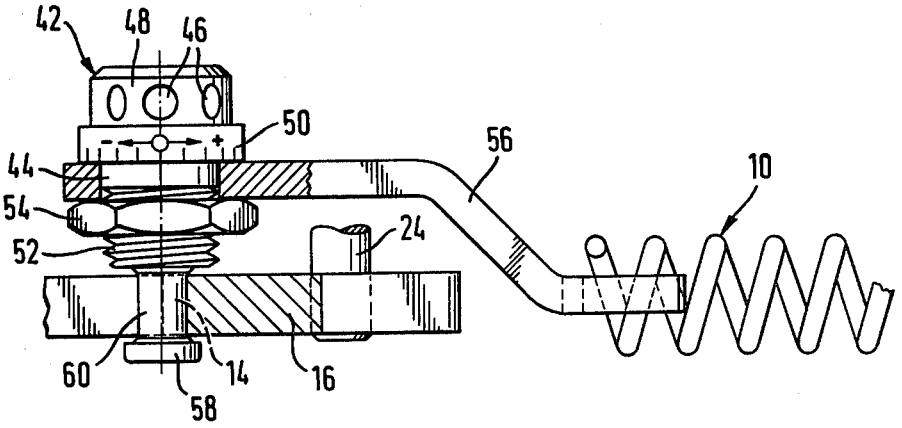
FIG. 4 illustrates a plan view of the tensioning apparatus of FIG. 3.

Referring to FIGS. 3 and 4, wherein like reference characters indicate like parts as above, the eccentric element 42 may be mounted between the spring 10 and the lever 18. To this end, a link 56 is connected to the end of the spring 10 adjacent the lever 18 and the shaft 44 of the eccentric element 42 is rotatably mounted in the link 56. As indicated in FIG. 4, the link 56 has a substantially Z-shape which is sufficient to pass about the lever arm 16. In addition, the eccentric element 42 has a pin 60 which extends from the shaft 44 in eccentric manner to engage with the arm 16 between a pair of teeth 14. In this case, the eccentric pin 60 is provided with a bead 58 at the outer end to abut against the side of the arm 16.

During operation, the eccentric element 42 can be rotated in the link 57 so that the pin 60 can move into the position illustrated. In this case, the link 56 is moved, for example, over the distance Y along the arm 16. In this way, the force acting on the arm 16 can be varied.

Of note, the tension spring 10 may be provided with links 38, 56 at each end for connection with eccentric elements 42 at each end. In this way, the described movements X, Y can be combined with one another. Further, instead of having teeth 14 on the arm 16, the engagement means may be in the form of holes which are longitudinally spaced along the lever arm 16.

The invention thus provides a relatively simple tensioning apparatus for adjusting the tension on a whip roll tensioning lever without having to disengage the lever from the force storage means and without having to move the tensioning lever into an inoperative position.

The invention further provides a tensioning apparatus which, when used on opposite ends of a whip roll, permits a tension equilization by a simple turning of the eccentric element without any need to disengage the spring from the tensioning lever.

What is claimed is:

1. In a weaving machine, the combination comprising
- a pair of pivotally mounted tensioning levers, each said lever having a pair of arms;
- a whip roll mounted at opposite ends on one arm of each said lever;
- a force storage means connected to the other arm of one of said levers for biasing each said lever; and
- an adjustable eccentric element fixedly connected to said respective force storage means for adjusting the force exerted on said one lever by said force storage means.

2. The combination as set forth in claim 1 which further comprises a stationary side plate in said weaving machine and wherein said eccentric element has a shaft rotatably mounted in said side plate.

3. The combination as set forth in claim 1 which further comprises a link connected between said force storage means and said eccentric element, said eccentric element engaging said other arm of said one lever.

4. The combination as set forth in claim 3 wherein said eccentric element includes an eccentrically mounted pin engaging said other arm of said lever.

5. A tensioning apparatus for a whip roll of a weaving machine comprising
- at least one pivotally mounted double-armed lever;
- a force storage means connected to one arm of said lever to basis said lever in one direction; and
- an adjustable eccentric element fixedly connected to said force storage means for adjusting the force exerted on said lever by said force storage means.

6. A tensioning apparatus as set forth in claim 5 wherein said eccentric element includes a shaft rotatably mounted on a first axis and a pin extending from said shaft on a second axis parallel to and spaced from said first axis.

7. A tensioning apparatus as set forth in claim 6 wherein said arm has a plurality of longitudinally spaced teeth and said pin is engaged with said arm between a pair of said teeth.

8. A tensioning apparatus as set forth in claim 7 which further comprises a link connected to said force storage means and having said shaft of said eccentric element rotatably mounted therein.

9. A tensioning apparatus as set forth in claim 5 wherein said force storage means is spring.

10. A tensinoning apparatus as set forth in claim 9 which further comprises a link connected to said spring at one end wherein said eccentric element includes a shaft rotatably mounted in said link and a pin extending from said shaft eccentrically thereof, said pin being disposed in engagement with said arm.

11. A tensioning apparatus as set forth in claim 10 wherein said arm has a plurality of longitudinally spaced teeth with said pin being engaged between a pair of said teeth.

12. In combination,
- a support plate;
- a double-armed lever pivotally mounted on said plate to support a whip roll of a weaving machine on one arm thereof;
- a force storage means connected between said plate and a second arm of said lever; and
- an adjustable eccentric element fixedly connected to said force storage means for adjusting the mounting of said force storage means relative to one of said plate and said lever.

13. The combination as set forth in claim 12 wherein said eccentric element includes a shaft rotatably mounted in said plate on a first axis and a pin extending from said shaft on a second axis parallel to and spaced from said first axis, said pin being connected to said force storage means at one end.

14. The combination as set forth in claim 12 which further comprises a link connected to one end of said force storage means and wherein said eccentric element includes a shaft rotatably mounted in said link an d a pin extending from said shaft eccentrically thereof, said pin being disposed in engagement with said second arm.

15. The combination as set forth in claim 14 wherein said second arm has a plurality of longitudinally spaced teeth with said pin being engaged between a pair of said teeth.

16. The combination as set forth in claim 12 wherein said force storage means is a tension spring.

* * * * *

UNITED STATES PATENT AND TRADEMARK OFFICE

CERTIFICATE OF CORRECTION

PATENT NO. : 4,483,372

DATED : November 20, 1984

INVENTOR(S) : Hans Demuth

It is certified that error appears in the above-identified patent and that said Letters Patent is hereby corrected as shown below:

| Column | Line | Change From | To |
|---|---|---|---|
| 2 | 54 | "fixed" | --fixedly-- |
| 3 | 31 | "57" | --56-- |

Signed and Sealed this

*Twenty-third* Day of *April 1985*

[SEAL]

*Attest:*

DONALD J. QUIGG

*Attesting Officer* *Acting Commissioner of Patents and Trademarks*